US005408048A

United States Patent [19]

Endo et al.

[11] Patent Number: 5,408,048

[45] Date of Patent: Apr. 18, 1995

[54] PRESSURE-WELDING TYPE ELECTRIC TERMINAL

[75] Inventors: Takayoshi Endo; Satoshi Yamada; Mitsuhiro Matsumoto, all of Shizuoka, Japan

[73] Assignee: Yazaki Corporation, Tokyo, Japan

[21] Appl. No.: 189,844

[22] Filed: Feb. 1, 1994

[30] Foreign Application Priority Data

Feb. 3, 1993 [JP] Japan ..... 5-016182

[51] Int. Cl.[6] ..... H01R 4/24

[52] U.S. Cl. ..... 174/74 R; 174/84 C; 174/94 R; 439/395; 439/884; 439/877

[58] Field of Search ..... 174/74 R, 94 R, 84 R, 174/84 C; 439/395, 884, 888, 877

[56] References Cited

U.S. PATENT DOCUMENTS

| | | | |
|---|---|---|---|
| 4,390,231 | 1/1983 | Plyer et al. | 439/884 |
| 4,554,406 | 11/1985 | Slavin et al. | 174/94 R |
| 4,840,578 | 6/1989 | Sato | 439/877 |
| 4,945,192 | 7/1990 | Urushibata et al. | 174/94 R |
| 4,963,699 | 10/1990 | Urushibata et al. | 174/88 R |
| 5,207,603 | 5/1993 | Peloza | 439/884 |

FOREIGN PATENT DOCUMENTS

| | | | |
|---|---|---|---|
| 433625 | 6/1991 | European Pat. Off. | 439/395 |
| 3-66156 | 6/1991 | Japan . | |

*Primary Examiner*—Morris H. Nimmo
*Attorney, Agent, or Firm*—Armstrong, Westerman, Hattori, McLeland & Naughton

[57] ABSTRACT

A pressure-welding type electric terminal according to the present invention is constructed such that it comprises an electrically contacting section and an electric wire connecting section which is composed of an electric wire pressure-welding section and an electric wire retaining section, wherein the electric wire pressure-welding section further comprises: a sub-plate section provided at one part of a longitudinal side of the base plate by way of a connecting portion and superposed on the base plate, which sub-plate section being integrally provided with a sub section having two consecutive elongate holes; an upright section formed with a slot therein for receiving an electric wire, which upright section being formed by vertically folding the sub section; and a pair of fixing pieces for firmly fixing the superposed sub-plate section at the front and rear sides of the upright section respectively.

Since the present invention is constructed as such, even when an electric wire rather on the fat side is pressed against the wire pressure-welding section to electrically connect thereto, it will not be expandedly deformed neither forward nor backward, providing thereby a sufficient durability.

2 Claims, 6 Drawing Sheets

PRESSURE-WELDING TYPE ELECTRIC TERMINAL

BACKGROUND OF THE INVENTION

1. Field of the Invention

The present invention relates to a structure of a pressure-welding type electric terminal having an electric wire pressure-welding section with a slot therein, which is capable of directly connecting an electric wire by fitting it in the wire pressure-welding section.

2. Description of the Prior Art

There is shown a conventionally used pressure-welding type electric terminal in FIG. 9 (Japanese Utility Model Laid-Open No. 3-66156), wherein a female pressure-welding terminal a is constructed such that a female electrically contacting section c is first formed at the front side of a base plate b made of an electrically conductive metal plate by punching out and bending the front side thereof, then there is also formed an upright electric wire pressure-welding section g having a substantially reverse U-shape with a slot f therein for cutting an insulating coat d of a lead of the electric wire i, and also a wire retaining section h is formed at a further rear side of the base plate b, wherein the electric wire i is pressed against the wire pressure-welding section g by use of a pressing jig or the like to be electrically connected thereto.

However, in the above structure, if an electric wire i is too fat as shown in FIG. 10, the reverse U-shape wire pressure-welding section g is likely to be expanded in the lateral direction p, so that the wire welding operation cannot be done sufficiently well, and also expanded in the longitudinal direction g, so that the whole longitudinal length of the pressure-welding terminal a is extended and consequently it cannot be accommodated in a connector housing (not shown), whereby it is likely to cause a short-circuit accident or the like.

FIGS. 11 and 12 show another conventional pressure-welding terminal having an improved structure of the above terminal, wherein a pressure-welding terminal a′ is constructed such that the side walls j, j are set upright at a part of the respective longitudinal sides of the base plate b′, and a wire pressure-welding section g′ is formed by superposing the respective bent pieces k, k of the side walls j, j forming an aligned slot f′, and also a wire retaining section h′ is formed at a far end behind the wire pressure-welding section g′.

However, in this structure above, although a hollow portion k1 and a protruded portion k2 are respectively formed in each of the bent pieces k, k so as to be coupled with each other to make a complete alignment of these two bent pieces k, k to obtain a slot f, there is still such a defect that the quality of the wire pressure-welding section g′ of each pressure-welding terminal as constructed above is not consistent.

SUMMARY OF THE INVENTION

Accordingly, it is an object of the present invention to provide a pressure-welding terminal having a substantially strong wire pressure-welding section whose slot for cutting the insulating coat of an electric wire is completely aligned.

In order to attain the above object, the pressure-welding terminal according to the present invention is constructed such that it includes a base plate, an electrically contacting section, and an electric wire connecting section which is composed of an electric wire pressure-welding section and an electric wire retaining section; wherein the electric wire pressure-welding section further comprises a sub-plate section provided at one part of a longitudinal side of the base plate by way of a connecting portion and superposed on the base plate, which sub-plate section being integrally provided with a sub section having two consecutive elongate holes, an upright section formed with a slot therein for receiving an electric wire, which upright section being formed by vertically folding the sub section of the sub-plate section so that the elongate holes are aligned to make a slot; and a pair of fixing pieces for firmly fixing the superposed sub-plate section at the front and rear sides of the upright section respectively.

In the above structure, the fixing pieces to be folded provided at the other longitudinal side of the base plate functions in such a way as to prevent the wire pressure-welding section from being expandedly deformed in neither the longitudinal nor lateral directions when pressingly welding the electric wire into the slot.

BRIEF DESCRIPTION OF THE DRAWINGS

The specific nature of the present invention, as well as other objects, usage and advantages thereof will become more apparent from the following description taken in conjunction with the accompanying drawings in which.

DETAILED DESCRIPTION OF THE PREFERRED EMBODIMENTS

Figure 1:
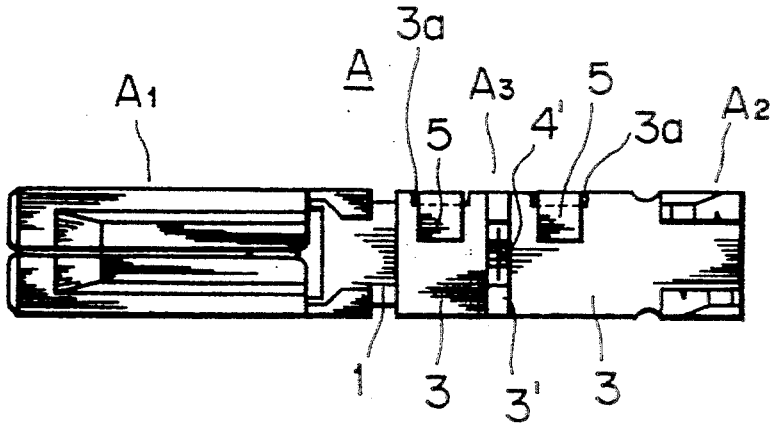
FIG. 1 is a plan view showing one embodiment of a pressure-welding type terminal of the present invention.
Figure 2:
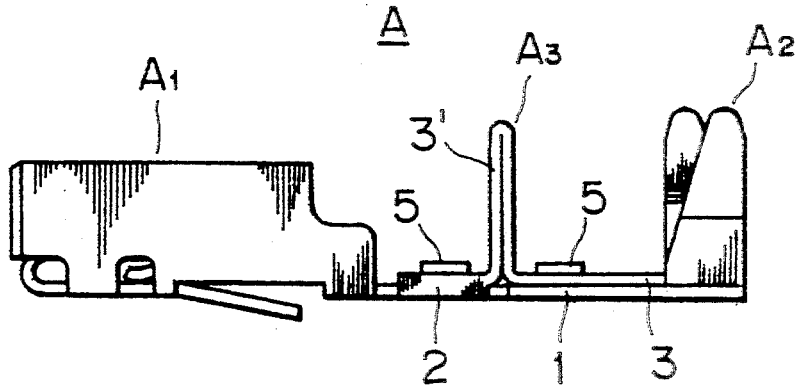
FIG. 2 is a side view of the embodiment of FIG. 1.
Figure 3:
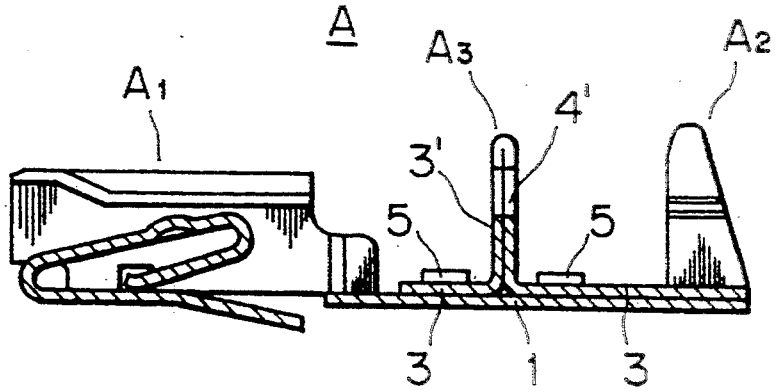
FIG. 3 is a longitudinal cross-sectional view of the same.
Figure 4:
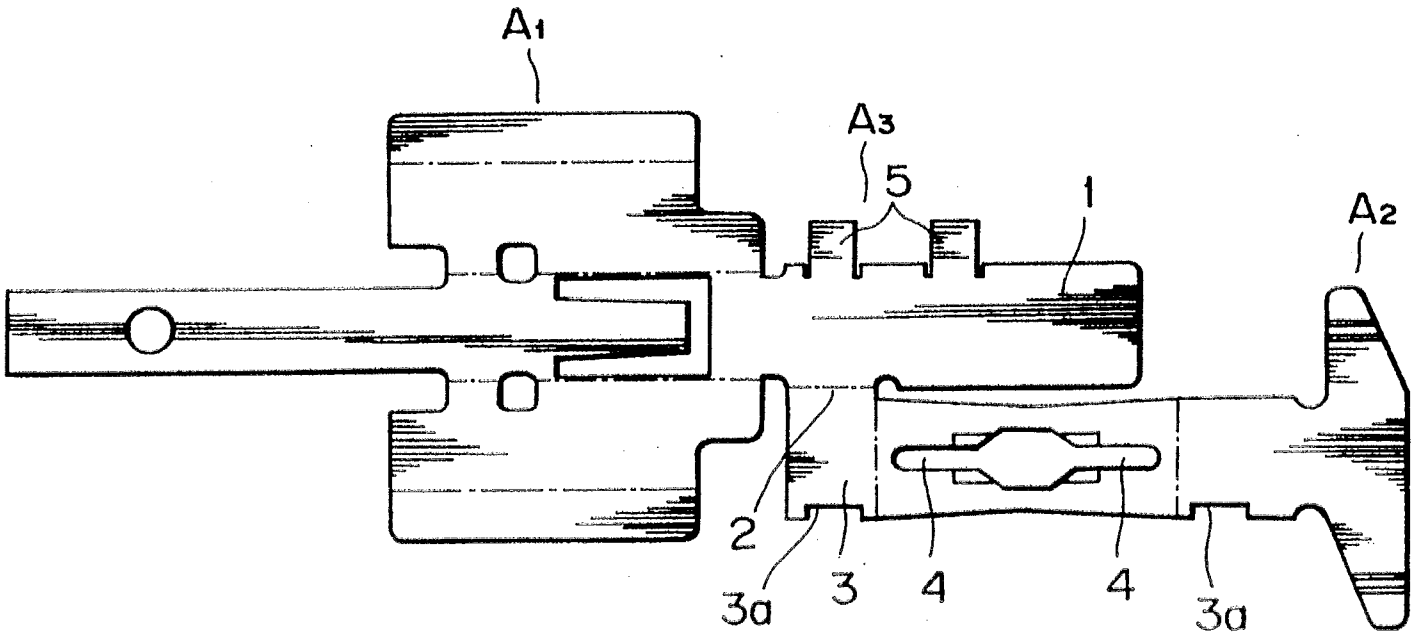
FIG. 4 is a perspective view of the same.

As shown in FIGS. 1 to 4, a pressure-welding terminal A is constructed such that it comprises a female electrically contacting portion A1 at its front side, an electric wire retaining section A2 at the rear side, and a wire pressure-welding section A3 therebetween, wherein the wire pressure-welding section A3 and the wire retaining section A2 are forming a wire connecting section altogether.

In the above construction, the wire pressure-welding section A3 is further constructed such that a sub-plate section 3 which is provided at one part of a longitudinal side of the base plate 1 by way of a connecting portion 2 is first formed on the base plate, and then an upright section 3′ is formed by vertically folding a sub section having two consecutive elongate holes 4, 4 which is integrally provided to the sub-plate section 3 to put the holes in a face-to-face relation to form an aligned slot 4' for receiving an electric wire, and thereafter a pair of fixing pieces 5, 5 provided at the other longitudinal side of the base plate 1 are set on the hollow portions *3a, 3a* formed respectively at the front and rear sides of the upright section 3' to be pressed against the superposed sub-plate section 3. It is to be noted that in this embodiment the aforementioned wire retaining section A2 is integrally formed at the rear end of the superposed sub-plate section 3.

Figure 5:
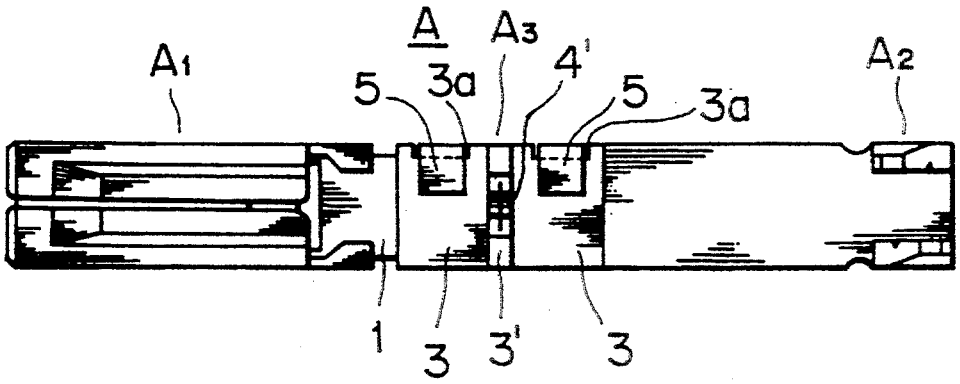
FIG. 5 is a plan view showing another embodiment of a pressure-welding type terminal of the present invention.
Figure 6:
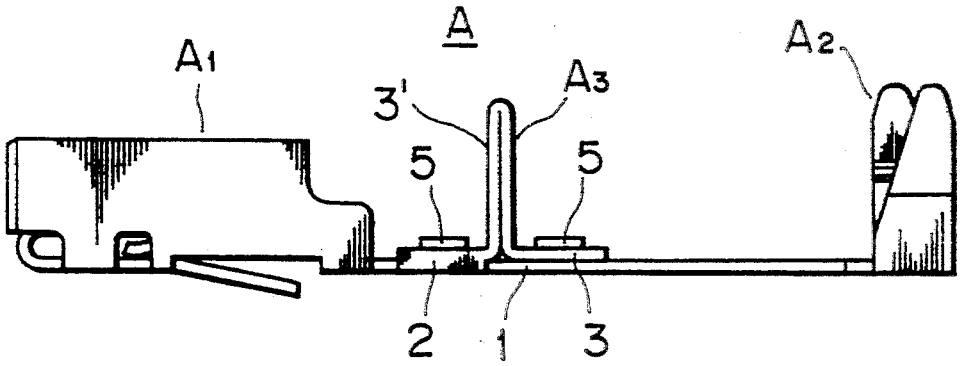
FIG. 6 is a side view of the embodiment of FIG. 5.
Figure 7:
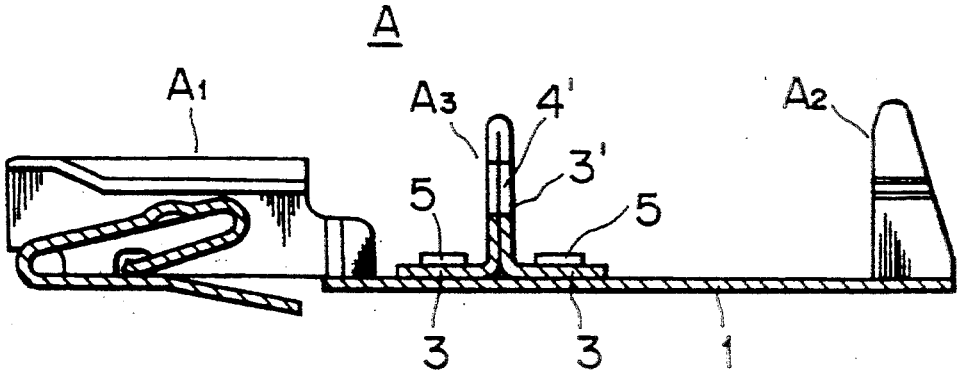
FIG. 7 is a longitudinal cross-sectional view of the same.
Figure 8:
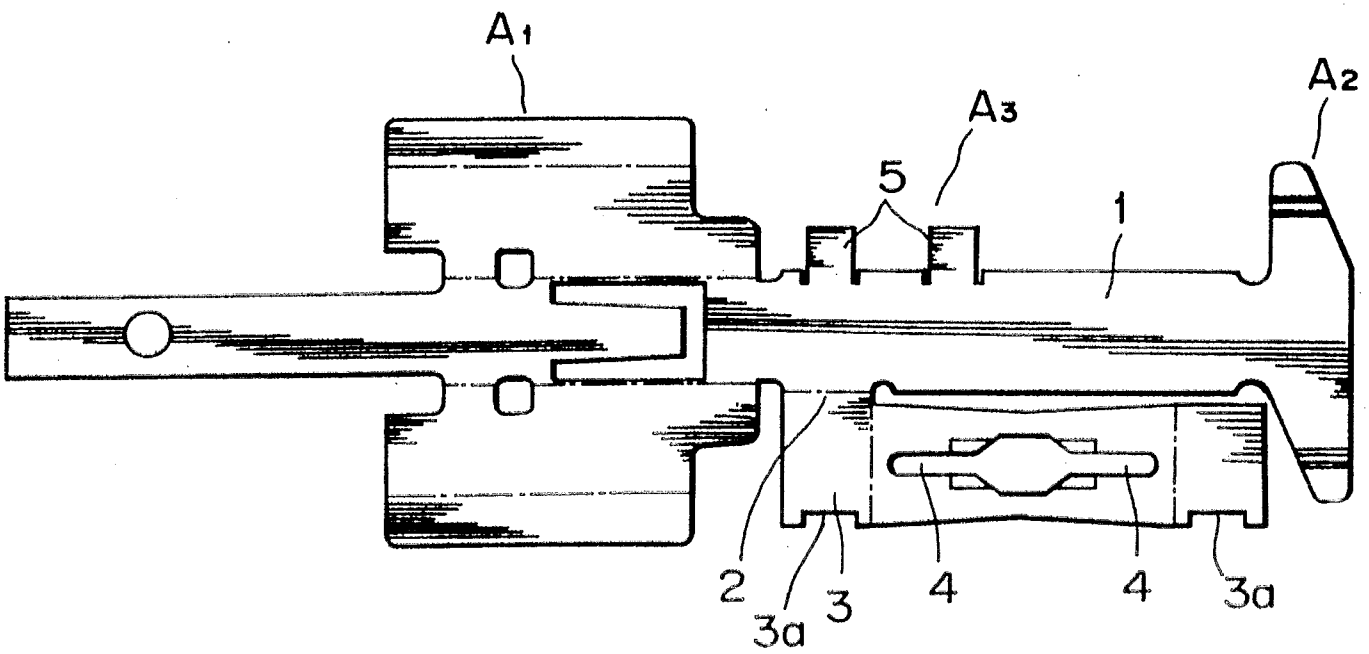
FIG. 8 is a perspective view of the same.
Figure 9:
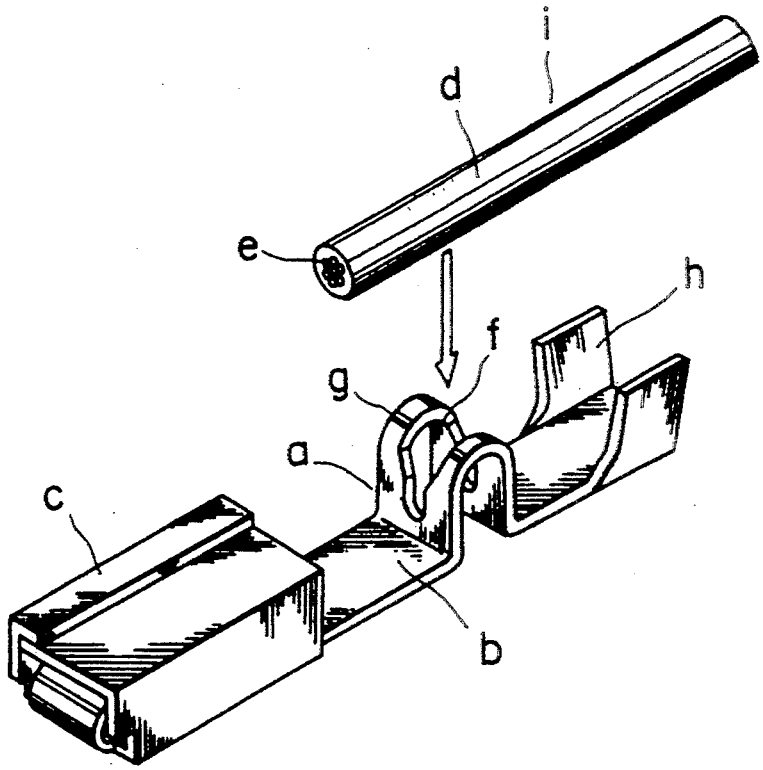
FIG. 9 PRIOR ART
FIG. 9 is a perspective view of a conventional pressure-welding type terminal.
Figure 10:
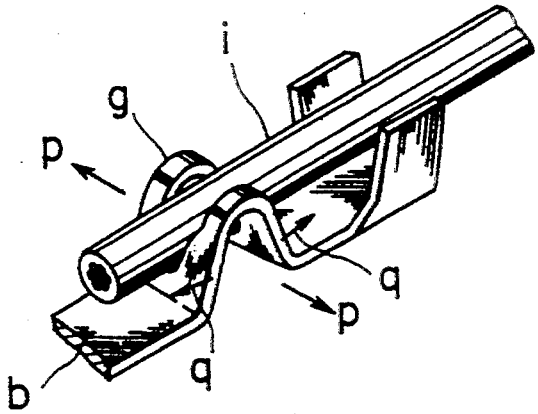
FIG. 10 PRIOR ART
FIG. 10 is an illustration showing a deformation of the important part of the conventional type terminal of FIG. 9.
Figure 11:
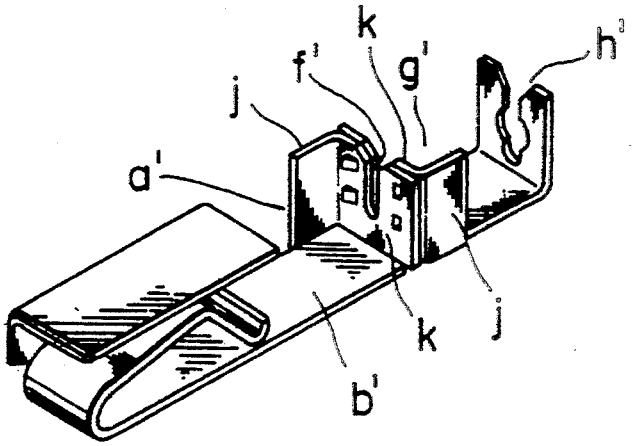
FIG. 11 PRIOR ART
FIG. 11 is a perspective view of another conventionally used terminal.
Figure 12:
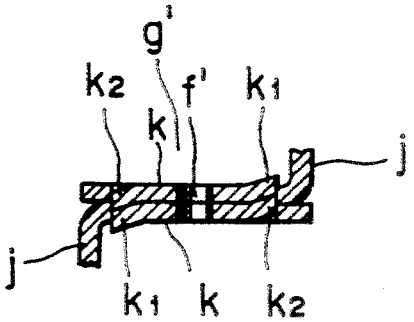
FIG. 12 PRIOR ART
FIG. 12 is a sectional view of the important part of the terminal of FIG. 11.

In FIGS. 5 to 8, there is shown another embodiment of the present invention, wherein a wire retaining section A2 is consecutively formed at the rear end of the base plate 1, or otherwise it is exactly the same as the above embodiment.

Effect of the Invention

In the present invention, since preliminary formed consecutive elongate holes make a slot at an upright section constructing the wire pressure-welding section, there is no occurrence of misalignment of the slot therein and further since the superposed sub-plate section is firmly fixed at the front and rear sides of the upright section by use of fixing pieces provided at the opposite side to the wire connecting section, even when an electric wire rather on the fat side is pressed against the wire pressure-welding section to electrically connect thereto, it will not be expandedly deformed neither frontward nor backward thereby providing a sufficient durability.

While the invention has been described with reference to specific embodiments, the description is illustrative and is not construed as limiting the scope of the invention. Various modifications and changes may occur to those skilled in the art without departing from the spirit and scope of the invention as defined by the appended claims.

What is claimed is;

1. A pressure-welding type electric terminal comprising an electrically contacting section and an electric wire connecting section which further includes an electric wire pressure-welding section and an electric wire retaining section; said electric wire pressure-welding section further comprising;

a sub-plate section provided at one part of a longitudinal side of a base plate by way of a connecting portion and superposed on said base plate, said sub-plate section being integrally provided with a sub section having two consecutive elongate holes;

an upright section formed with a slot therein for receiving an electric wire, said upright section being formed by vertically folding said sub section of said sub-plate section; and a pair of fixing pieces for firmly fixing said superposed sub-plate section at the front and rear sides of said upright section respectively.

2. A pressure-welding type electric terminal as claimed in claim 1, wherein said electric wire retaining section is integrally formed at one end of said sub-plate section.

* * * * *